US008736644B2

(12) United States Patent
Li et al.

(10) Patent No.: US 8,736,644 B2
(45) Date of Patent: May 27, 2014

(54) LIQUID CRYSTAL DISPLAY DEVICE

(75) Inventors: Shi-Qi Li, Shenzhen (CN); Xiao-Hui Yao, Shenzhen (CN); Zuo-Min Liao, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 230 days.

(21) Appl. No.: 13/320,256

(22) PCT Filed: Sep. 28, 2011

(86) PCT No.: PCT/CN2011/080265

§ 371 (c)(1),
(2), (4) Date: Nov. 11, 2011

(87) PCT Pub. No.: WO2013/023401

PCT Pub. Date: Feb. 21, 2013

(65) Prior Publication Data

US 2013/0044094 A1 Feb. 21, 2013

(30) Foreign Application Priority Data

Aug. 16, 2011 (CN) ..... 2011 1 0234881

(51) Int. Cl.
*G09G 5/00* (2006.01)

(52) U.S. Cl.
USPC ..... 345/694; 349/144

(58) Field of Classification Search
USPC ..... 345/211, 694; 349/48, 33, 144, 124
See application file for complete search history.

(56) References Cited

U.S. PATENT DOCUMENTS

| | | | | |
|---|---|---|---|---|
| 5,870,075 | A * | 2/1999 | Yamazaki et al. | 345/92 |
| 6,057,905 | A * | 5/2000 | Nakajima | 349/146 |
| 6,515,728 | B1 | 2/2003 | Song et al. | |
| 2008/0158456 | A1 * | 7/2008 | Hsieh et al. | 349/38 |
| 2009/0244425 | A1 * | 10/2009 | Jung et al. | 349/48 |
| 2009/0310074 | A1 * | 12/2009 | Kim et al. | 349/139 |

FOREIGN PATENT DOCUMENTS

| | | | |
|---|---|---|---|
| CN | 101051139 | A | 10/2007 |
| CN | 101361109 | A | 2/2009 |
| CN | 101498875 | A | 8/2009 |
| CN | 101546073 | A | 9/2009 |
| KR | 10-2008-0020335 | A | 3/2008 |

* cited by examiner

*Primary Examiner* — Abbas Abdulselam
(74) *Attorney, Agent, or Firm* — Cheng-Ju Chiang

(57) ABSTRACT

The present invention provides a liquid crystal display device, which includes a plurality of pixel units arranged in a matrix form. Each of the pixel units further includes a first sub-pixel electrode and a second sub-pixel electrode. The first sub-pixel electrode is set at a central position of the pixel unit. The second sub-pixel electrode is circumferentially set along a circumference of the first sub-pixel electrode. With the above arrangement, the present invention improves the γ view angle characteristics of the liquid crystal display device to provide enhanced performance of displaying of the liquid crystal display device and thus improving quality of displaying.

14 Claims, 10 Drawing Sheets

LIQUID CRYSTAL DISPLAY DEVICE

BACKGROUND OF THE INVENTION

1. Field of the Invention

The present invention relates to the field of liquid crystal displaying techniques, and in particular to a liquid crystal display device that improves gamma (γ) characteristics.

2. The Related Arts

Recently, liquid crystal displaying techniques undergo fast development and become a hot spot of research. Due to the advantages of high resolution, reduced thickness, light weight, and low power consumption, the liquid crystal display devices find wide applications in the field of displaying for medical sectors, advertisements, military purposes, exhibitions, and entertainments. FIG. 1 is a schematic view illustrating the structure of a known liquid crystal display device. The known liquid crystal display device 1 comprises a liquid crystal display panel 10 and a backlight module 12. The liquid crystal display panel 10 comprises a first substrate 11, a second substrate 13, and a liquid crystal layer 15. The first substrate 11 is an electrode substrate, while the second substrate 13 is a color filter substrate. The liquid crystal layer 15 is sandwiched between the first substrate 11 and the second substrate 13. FIG. 2 is an equivalent circuit diagram of each pixel unit included in the liquid crystal display device 1. The liquid crystal display device 1 comprises a plurality of pixel unit 110 that is arranged in a matrix form. As shown in FIG. 2, each of the pixel units 110 further comprises: a scan line 1101, a data line 1102, a thin film transistor 1103, and a pixel electrode 1104.

Specifically, the scan line 1101 and the data line 1102 are arranged to cross and isolate from each other. The gate terminal of the thin film transistor 1103 is connected to the scan line 1101. The source terminal of the thin film transistor 1103 is connected to the data line 1102. The drain terminal of the thin film transistor 1103 is connected to the pixel electrode 1104. When the scan line 1101 supplies a scan signal to turn on the gate terminal of the thin film transistor 1103, the pixel electrode 1104 receives a corresponding drive voltage from the data line 1102 to display a corresponding image.

The characteristics of displaying of the known liquid crystal display device 1 will be described as follows.

The liquid crystal display device 1 adopts twisted nematic (TN) mode, which controls the amount of light transmitting through the liquid crystal layer by applying the characteristics that optic chirality of liquid crystal molecules varies with the change of voltage applied. However, when a user views the liquid crystal display device 1 in an inclined direction, contrast of the liquid crystal display device 1 is greatly reduced. Further, when a user changes from viewing the display in an inclined direction toward viewing the display in a front direction, difference of brightness in a number of gray levels from black to white can be obviously perceived. Further, the TN mode liquid crystal display device shows a characteristic of gray level reversal, for example a darker portion when viewed in the front side becoming brighter when viewed in an inclined direction.

Specifically, as shown in FIGS. 3-5, FIG. 3 shows a plot of relationship between a drive voltage applied to the known liquid crystal display device 1 and transmittance, in which curve 301 is a plot of drive voltage and transmittance by taking a front view angle to observe the known liquid crystal display device 1, curve 302 is a plot of drive voltage and transmittance by taking an angle of 30° shifted from the front view angle to observe the known liquid crystal display device 1, and curve 303 is a plot of drive voltage and transmittance by taking an angle of 60° shifted from the front view angle to observe the known liquid crystal display device 1.

FIG. 4 is a plot of standardized transmittance curves by standardizing the curves of FIG. 3 with respect to white displaying, in which curve 401 is a plot of standardized transmittance of observing the known liquid crystal display device 1 at the front view angle, curve 402 is a plot of standardized transmittance of observing the known liquid crystal display device 1 at an angle of 30° shifted from the front view angle, and curve 403 is a plot of standardized transmittance of observing the known liquid crystal display device 1 at an angle of 60° shifted from the front view angle.

FIG. 5 is a plot of gamma (γ) characteristic of the known liquid crystal display device 1. Gamma (γ) characteristic is an indication of the gray level dependence of brightness, wherein gray level displaying condition is changed with the observation direction. Thus, the γ characteristics obtained for observations made at the front view angle and other viewing angles that are shifted from the front view angle (such as that shifted from the front view angle by 30° and that shifted from the front view angle by 60°) are different from each other. As shown in FIG. 5, curve 501 is a plot of gray level characteristic of the known liquid crystal display device 1 taken at the front view angle, curve 502 is a plot of gray level characteristic of the known liquid crystal display device 1 taken at an angle shifted from the front view angle by 30°, and curve 503 is a plot of gray level characteristic of the known liquid crystal display device 1 taken at an angle shifted from the front view angle by 60°. Since great deviations exist between curves 502 and 503 and the front view angle gray level characteristic curve 501, it is apparent that γ characteristic of the liquid crystal display device 1 is poor.

Thus, it is desired to have a liquid crystal display device that overcomes the above problems.

SUMMARY OF THE INVENTION

The technical issue to be addressed by the present invention is to provide a liquid crystal display device, which provides enhanced performance of displaying of the liquid crystal display device through improving γ characteristic of the liquid crystal display device so as to enhance the quality of displaying.

The present invention provides a liquid crystal display device, which comprises: a plurality of pixel units arranged in a matrix form. Each of the pixel units further comprises: a first sub-pixel electrode, which is set at a central position of the pixel unit; and a second sub-pixel electrode, which is circumferentially set along a circumference of the first sub-pixel electrode; wherein area of the first sub-pixel electrode and area of the second sub-pixel electrode are of a ratio of 1:2, a drive voltage of a liquid crystal layer corresponding to the first sub-pixel electrode being a first drive voltage, a drive voltage of a liquid crystal layer corresponding to the second sub-pixel electrode being a second drive voltage, the first drive voltage being less than the second drive voltage.

According to a preferred embodiment of the present invention, the pixel unit further comprises: a scan line; a data line, which is isolated from the scan line; a first thin film transistor, which has a gate terminal connected to the scan line, the first thin film transistor having a source terminal connected to the data line, the first thin film transistor having a drain terminal connected to the first sub-pixel electrode; a second thin film transistor, which has a gate terminal connected to the scan line, the second thin film transistor having a source terminal connected to the data line, the second thin film transistor having a drain terminal connected to the second sub-pixel electrode; a first auxiliary capacitor and a first auxiliary capacitor line, the first auxiliary capacitor having an auxiliary electrode connected to the first sub-pixel electrode, the first auxiliary capacitor having an opposite electrode connected to the first auxiliary capacitor line; and a second auxiliary capacitor and a second auxiliary capacitor line, the second auxiliary capacitor having an auxiliary electrode connected to the second sub-pixel electrode, the second auxiliary capacitor having an opposite electrode connected to the second auxiliary capacitor line.

The present invention provides a liquid crystal display device, which comprises: a plurality of pixel units arranged in a matrix form. Each of the pixel units further comprises a first sub-pixel electrode and a second sub-pixel electrode, wherein the first sub-pixel electrode is set at a central position of the pixel unit and the second sub-pixel electrode is circumferentially set along a circumference of the first sub-pixel electrode.

According to a preferred embodiment of the present invention, the pixel unit further comprises: a scan line; a data line, which is isolated from the scan line; a first thin film transistor, which has a gate terminal connected to the scan line, the first thin film transistor having a source terminal connected to the data line, the first thin film transistor having a drain terminal connected to the first sub-pixel electrode; a second thin film transistor, which has a gate terminal connected to the scan line, the second thin film transistor having a source terminal connected to the data line, the second thin film transistor having a drain terminal connected to the second sub-pixel electrode; a first auxiliary capacitor and a first auxiliary capacitor line, the first auxiliary capacitor having an auxiliary electrode connected to the first sub-pixel electrode, the first auxiliary capacitor having an opposite electrode connected to the first auxiliary capacitor line; and a second auxiliary capacitor and a second auxiliary capacitor line, the second auxiliary capacitor having an auxiliary electrode connected to the second sub-pixel electrode, the second auxiliary capacitor having an opposite electrode connected to the second auxiliary capacitor line.

According to a preferred embodiment of the present invention, a drive voltage of a liquid crystal layer corresponding to the first sub-pixel electrode is a first drive voltage and a drive voltage of a liquid crystal layer corresponding to the second sub-pixel electrode is a second drive voltage, wherein the first drive voltage is less than the second drive voltage.

According to a preferred embodiment of the present invention, area of the first sub-pixel electrode and area of the second sub-pixel electrode are of a ratio of 1:2.

According to a preferred embodiment of the present invention, the first sub-pixel electrode is rectangular, circular, or elliptic and the second sub-pixel electrode has an outer circumference that is rectangular.

According to a preferred embodiment of the present invention, the first sub-pixel electrode comprises a first zone, a second zone, a third zone, and a fourth zone. The first zone and the second zone is arranged to juxtapose each other, the third zone is arranged diagonally with respect to the first zone, and the fourth zone is arranged diagonally with respect to the second zone.

According to a preferred embodiment of the present invention, the first zone and the third zone have same electrode direction and the second zone and the fourth zone have the same electrode direction.

According to a preferred embodiment of the present invention, the electrode direction of the first zone and the third zone is set in a first direction and the electrode direction of the second zone and the fourth zone is set in a second direction, the first direction and the second direction being normal to each other.

According to a preferred embodiment of the present invention, the first direction is a direction forming an included angle of 135° with respect to positive horizontal direction and the second direction is a direction forming an included angle of 45° with respect to the positive horizontal direction.

According to a preferred embodiment of the present invention, the second sub-pixel electrode has a first portion set outside the first zone and having an electrode direction corresponding to electrode direction of the first zone; the second sub-pixel electrode has a second portion set outside the second zone and having an electrode direction that corresponding to electrode direction of the second zone; the second sub-pixel electrode has a third portion set outside the third zone and having an electrode direction corresponding to electrode direction of the third zone; and the second sub-pixel electrode has a fourth portion set outside the fourth zone and having an electrode direction corresponding to electrode direction of the fourth zone.

The present invention provides a liquid crystal display device, which comprises: a plurality of pixel units arranged in a matrix form. Each of the pixel units further comprises: a pixel central portion, which is arranged at a center of the pixel unit; and a pixel edge portion, which is arranged along an edge of the pixel unit and circumferentially surrounds a circumference of the pixel central portion.

According to a preferred embodiment of the present invention, a drive voltage of a liquid crystal layer corresponding to the pixel central portion is a first drive voltage and a drive voltage of a liquid crystal layer corresponding to the pixel edge portion is a second drive voltage, wherein the first drive voltage is less than the second drive voltage.

According to a preferred embodiment of the present invention, area of the pixel central portion and area of the pixel edge portion are of a ratio of 1:2.

According to a preferred embodiment of the present invention, the pixel central portion is rectangular, circular, or elliptic and the pixel edge portion has an outer circumference that is rectangular.

The efficacy of the present invention is that to be distinguish from the state of the art, in the liquid crystal display device according to the present invention, each pixel unit is divided into a first sub-pixel electrode and a second sub-pixel electrode, and the first sub-pixel electrode is set at a central position of the pixel unit, while the second sub-pixel electrode is set along a circumference of the first sub-pixel electrode. Such a pixel structure may further improve the γ characteristic of the liquid crystal display device to provide enhanced performance of displaying of the liquid crystal display device and thus improving quality of displaying.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 6:
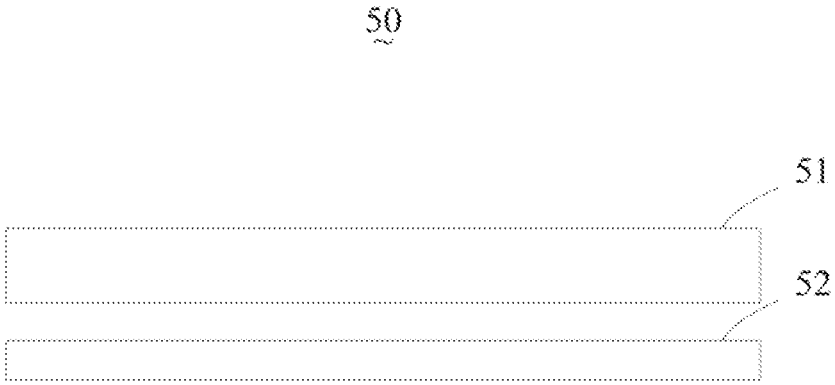
FIG. 6 is a schematic view illustrating the structure of a preferred embodiment of liquid crystal display device according to the present invention.

Referring to FIG. 6, FIG. 6 is a schematic view illustrating the structure of a preferred embodiment of liquid crystal display device according to the present invention. As shown in FIG. 6, the liquid crystal display device 50 according to the present invention comprises a liquid crystal display panel 51 and a backlight module 52.

In the instant embodiment, the liquid crystal display panel 51 and the backlight module 52 are stacked. The liquid crystal display panel 51 functions to display an image, while the backlight module 52 provides required backlighting to the liquid crystal display panel 51.

Figure 7:
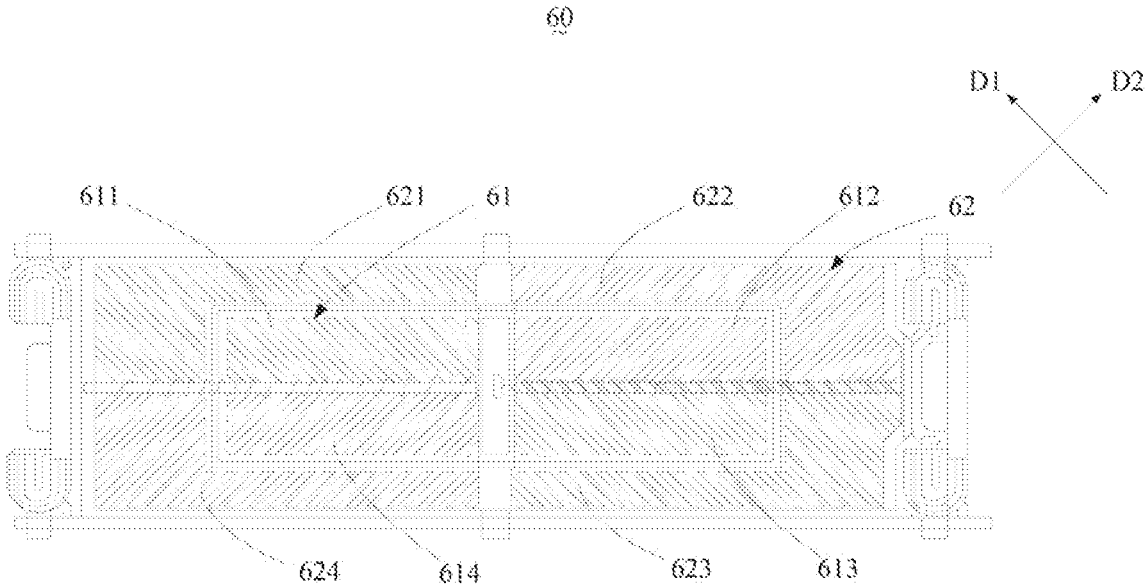
FIG. 7 is a schematic view showing the structure of one pixel unit of the liquid crystal display panel illustrated in FIG. 6.

FIG. 7 is a schematic view showing the structure of one pixel unit of the liquid crystal display panel 51 illustrated in FIG. 6. As shown in FIG. 7, the liquid crystal display panel 51 according to the present invention comprises a plurality of pixel units 60 arranged in a matrix form, wherein each of the pixel units 60 further comprises a first sub-pixel electrode 61 and a second sub-pixel electrode 62.

In the instant embodiment, the first sub-pixel electrode 61 is set at a central position of the pixel unit 60 and is rectangular in shape. The second sub-pixel electrode 62 is set along an edge of the pixel unit 60, specifically being circumferentially set along a circumference of the first sub-pixel electrode 61, and the second sub-pixel electrode 62 has an outer circumference that is rectangular. It is understood that in the present invention, the shape of the first sub-pixel electrode 61 is not limited to such a shape, and in other embodiments, the shape can be other shapes, such as circle, rhombus, and ellipse, provided that the first sub-pixel electrode 61 is set at a middle portion of the pixel unit 60 (preferably the central position of the pixel unit 60).

The first sub-pixel electrode 61 is further divided into multiple displaying zones, and in the instant embodiment, the first sub-pixel electrode 61 is divided into four zones: a first zone 611, a second zone 612, a third zone 613, and a fourth zone 614. The first zone 611 that is located at the upper left corner and the second zone 612 that is located at the upper right corner are arranged at the same level and juxtaposing each other, the third zone 613 that is located at the lower right corner is arranged diagonally with respect to the first zone 611, and the fourth zone 614 that is located at the lower left corner is arranged diagonally with respect to the second zone 612; the first zone 611 and the third zone 613 have the same electrode direction, such as the first direction D1 shown in the drawing, and the second zone 612 and the fourth zone 614 have the same electrode direction, such as the second direction D2 shown in the drawing. The first direction D1 can be for example a direction that forms an included angle of 135° with respect to positive horizontal direction, and the second direction D2 can be for example a direction that forms an included angle of 45° with respect to the positive horizontal direction.

Correspondingly, a first portion 621 of the second sub-pixel electrode 62 that is set outside and corresponding to the first zone 611 has an electrode direction that is identical to the electrode direction of the first zone 611, such as both being the first direction D1. A second portion 622 of the second sub-pixel electrode 62 that is set outside and corresponding to the second zone 612 has an electrode direction that is identical to the electrode direction of the second zone 612, such as both being the second direction D2. A third portion 623 of the second sub-pixel electrode 62 that is set outside and corresponding to the third zone 613 has an electrode direction that is identical to the electrode direction of the third zone 613, such as both being the first direction D1. A fourth portion 624 of the second sub-pixel electrode 62 that is set outside and corresponding to the fourth zone 614 has an electrode direction that is identical to the electrode direction of the fourth zone 614, such as both being the second direction D2.

In the instant embodiment, the first direction D1 and the second direction D2 are normal to each other. When liquid crystal drive voltage is applied to the first sub-pixel electrode 61 and the second sub-pixel 62, liquid crystal molecules (not shown) corresponding to the first sub-pixel electrode 61 show an inclination direction that is associated with the electrode structure of the first sub-pixel electrode 61. Thus, liquid crystal molecules located in the four zones 611, 612, 613, and 614 of the first sub-pixel 61 show inclination angles that are different from each other by 90°. The liquid crystal molecules (not shown) located in the second sub-pixel electrode 62 show an inclination direction that is determined by the electrode structure of the second sub-pixel electrode 62. Thus, the liquid crystal molecules located in the four portions 621, 622, 623, and 624 show inclination angles that are different from each other by 90°. Here, the liquid crystal display device 50 is a liquid crystal display device of MVA (Multi-Domain Vertical Alignment) type. It is understood that in the present invention, the liquid crystal display device 50 is not limited to MVA, and can be a liquid crystal display device of other types, such as IPS (In-Plane Switching).

Further, in the instant embodiment, a ratio between area of the first sub-pixel electrode 61 and area of the second sub-pixel electrode 62 is preferably 1:2.

Figure 8:
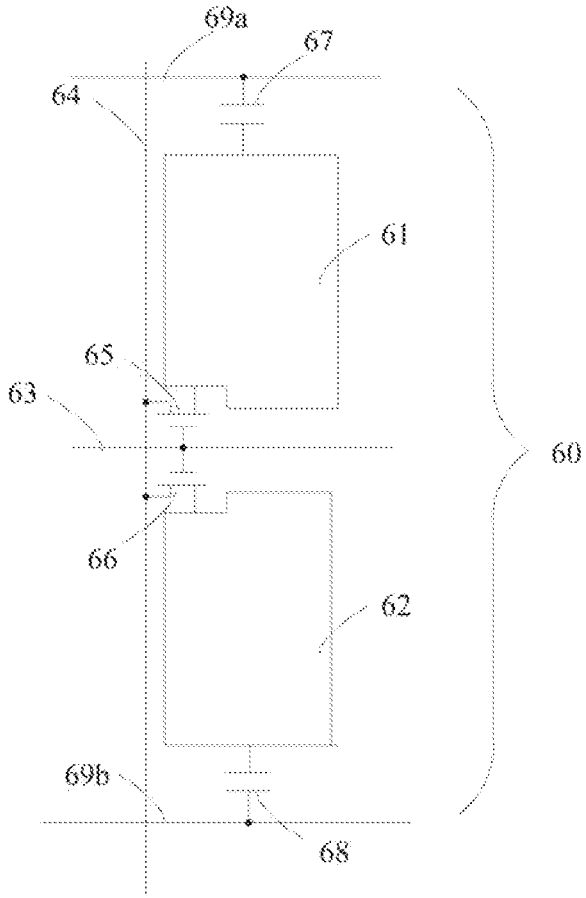
FIG. 8 is an equivalent circuit diagram of each pixel unit of the liquid crystal display device shown in FIG. 6.
Figure 9:
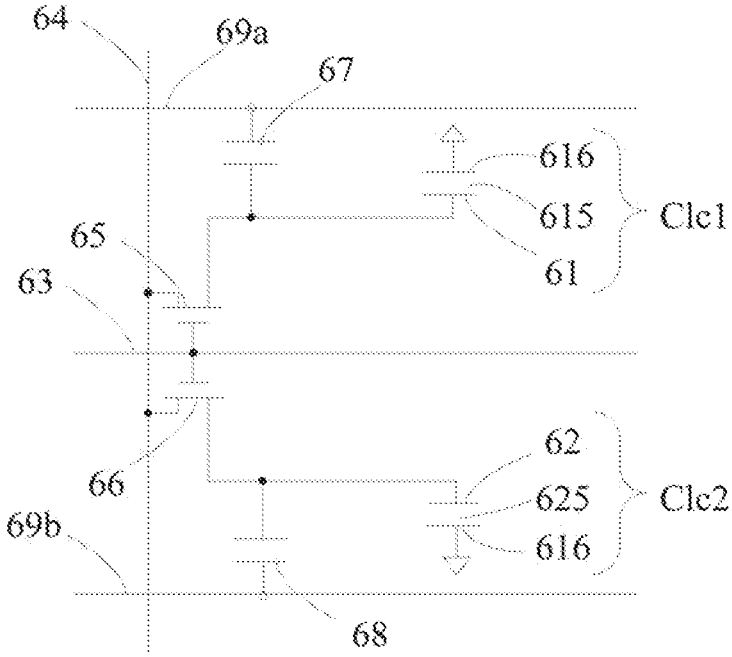
FIG. 9 is an equivalent circuit diagram of each pixel unit of the liquid crystal display device shown in FIG. 6.

FIGS. 8-9 show equivalent circuits of the pixel unit 60 of the liquid crystal display panel 51 shown in FIG. 6. As shown in FIG. 8, the pixel unit 60 comprises the first sub-pixel electrode 61, the second sub-pixel electrode 62, a scan line 63, a data line 64, a first thin film transistor 65, a second thin film transistor 66, a first auxiliary capacitor 67, a second auxiliary capacitor 68, a first auxiliary capacitor line 69*a*, and a second auxiliary capacitor line 69*b*.

In the instant embodiment, the data line 64 and the scan line 63 are isolated from each other. The gate terminal of the first thin film transistor 65 is connected to the scan line 63. The source terminal of the first thin film transistor 65 is connected to the data line 64. The drain terminal of the first thin film transistor 65 is connected to the first sub-pixel electrode 61. Further, an auxiliary electrode of the first auxiliary capacitor 67 is connected to the first sub-pixel electrode 61 and an opposite electrode of the first auxiliary capacitor 67 is connected to the first auxiliary capacitor line 69*a*. The gate terminal of the first thin film transistor 65 receives a scan signal from the scan line 63 to have the source terminal and the drain terminal of the first thin film transistor 65 conducted. The first sub-pixel electrode 61 receives a drive voltage from the data line 64 through the first thin film transistor 65.

The gate terminal of the second thin film transistor 66 is connected to the scan line 63. The source terminal of the second thin film transistor 66 is connected to the data line 64. The drain terminal of the first thin film transistor 66 is connected to the second sub-pixel electrode 62. Further, an auxiliary electrode of the second auxiliary capacitor 68 is connected to the second sub-pixel electrode 62, and an opposite electrode of the second auxiliary capacitor 68 is connected to the second auxiliary capacitor line 69*b*. The gate terminal of the second thin film transistor 66 receives a scan signal from the scan line 63 to have the source terminal and the drain terminal of the second thin film transistor 66 conducted. The second sub-pixel electrode 62 receives a drive voltage through the second thin film transistor 66.

As shown in FIG. 9, the first sub-pixel electrode 61 and the second sub-pixel electrode 62 shown in FIG. 8 have liquid crystal layers that are respectively represented by a first liquid crystal layer 615 and a second liquid crystal layer 625. Thus, the first sub-pixel electrode 61, the first liquid crystal layer 615, and a common electrode 616 that is opposite to the first sub-pixel electrode 61 form a first liquid crystal capacitor Clc1, and the second sub-pixel electrode 62, the second liquid crystal layer 625, and the common electrode 616 that is opposite to the second sub-pixel electrode 62 form a second liquid crystal capacitor Clc2. The first sub-pixel electrode 61 of the first liquid crystal capacitor Clc1 is connected to the auxiliary electrode of the first auxiliary capacitor 67 and the drain terminal of the first thin film transistor 65, and the second sub-pixel electrode 62 of the second liquid crystal capacitor Clc2 is connected to the auxiliary electrode of the second auxiliary capacitor 68 and the drain terminal of the second thin film transistor 66. In the instant embodiment, the first liquid crystal capacitor Clc1 and the second liquid crystal capacitor Clc2 are of identical static capacity and the first auxiliary capacitor 67 and the second auxiliary capacitor 68 are of identical static capacity.

When the scan line 63 supplies a scan signal, the first thin film transistor 65 and the second thin film transistor 66 are simultaneously set ON, where the first sub-pixel electrode 61 of the first liquid crystal capacitor Clc1, the second sub-pixel electrode 62 of the second liquid crystal capacitor Clc2, the auxiliary electrode of the first auxiliary capacitor 67, and the auxiliary electrode of the second auxiliary capacitor 68 are set in connection with the data line 64 and receive the same drive voltage. Since the opposite electrode of the first auxiliary capacitor 67 and the opposite electrode of the second auxiliary capacitor 68 are electrically independent of the first sub-pixel electrode 61 and the second sub-pixel electrode 62, the level of a first drive voltage applied to the first liquid crystal capacitor Clc1 can be controlled through adjustments of the capacity of the first auxiliary capacitor 67 and the voltage of the first auxiliary line 69*a*; similarly, the level of a second drive voltage applied to the second liquid crystal capacitor Clc2 can be controlled through adjustments of the capacity of the second auxiliary capacitor 68 and the voltage of the second auxiliary line 69*b*. In the instant embodiment, it is preferred that the first drive voltage is less than the second drive voltage.

As such, when various drive voltages are applied to the first sub-pixel electrode 61 and the second sub-pixel electrode 62, with observations being made for combination of various γ characteristics, the dependence of γ characteristic on field angle is improved, and thus, difference of drive voltage between the first sub-pixel electrode 61 and the second sub-pixel electrode 62 at low gray level is increased thereby improving the γ characteristic performance of the dark side (low brightness side) in a normally dark condition and enhancing displaying quality of the liquid crystal display device 50.

It is noted that in the instant embodiment, the first sub-pixel electrode 61 and the second sub-pixel electrode 62 are applied with various drive voltages through adjustments of the capacities of the first auxiliary capacitor 67 and the second auxiliary capacitor 68 and the voltage levels of the first auxiliary line 69*a* and the second auxiliary line 69*b*. In other embodiments, other measures may be taken to apply various drive voltages to the first sub-pixel electrode 61 and the second sub-pixel electrode 62, for example a first data line and a second data line being set up to respectively supply a first drive voltage and a second drive voltage.

The characteristics of displaying exhibited by the liquid crystal display device 50 according to the present invention will be described as follows.

Figure 10:
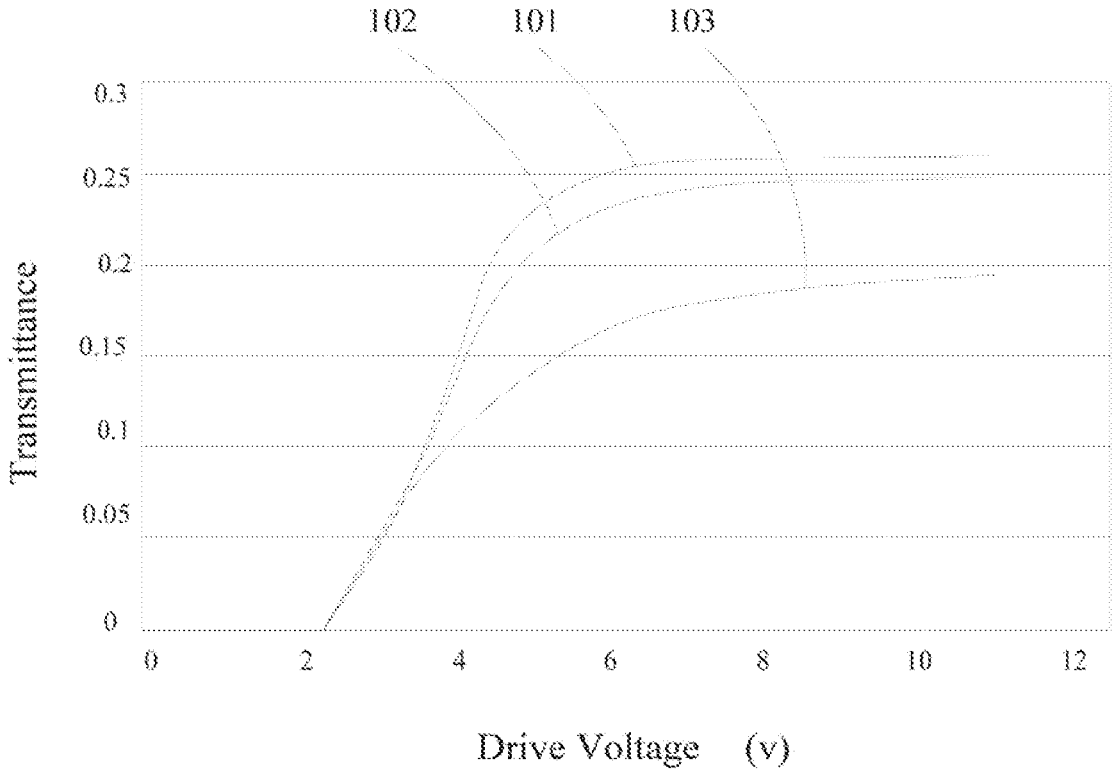
FIG. 10 is a plot of relationship between a drive voltage applied to the liquid crystal display device according to the present invention and transmittance.
Figure 11:
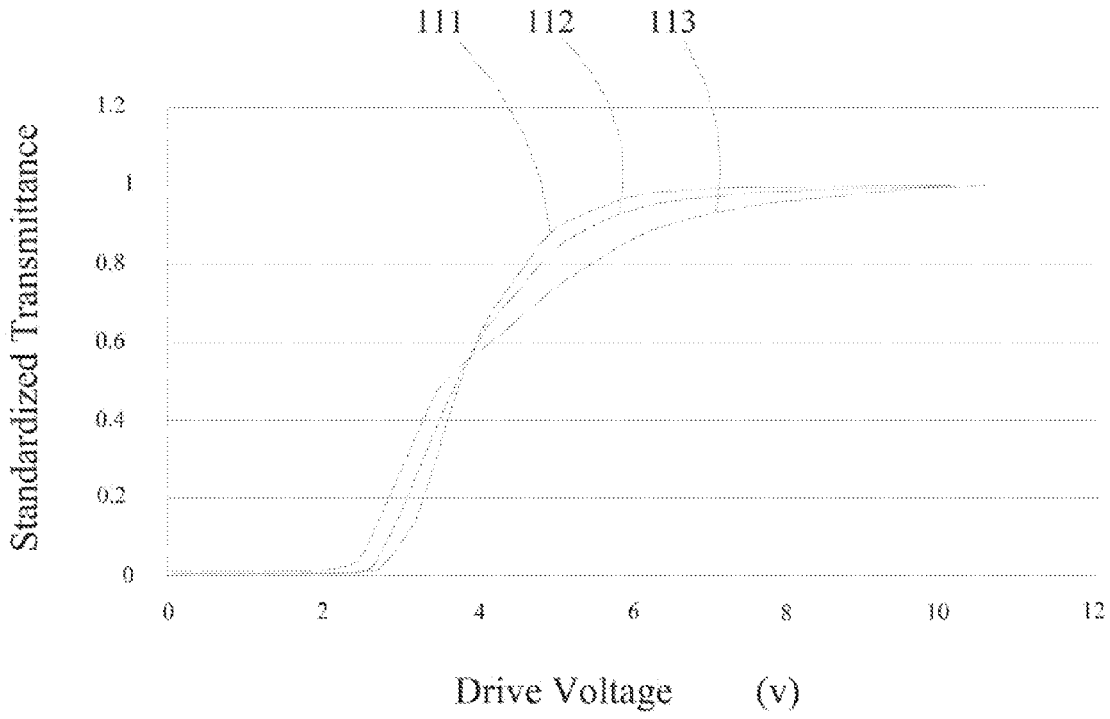
FIG. 11 is a plot of standardized transmittance curves by standardizing the curves of FIG. 10 with respect to white displaying.
Figure 12:
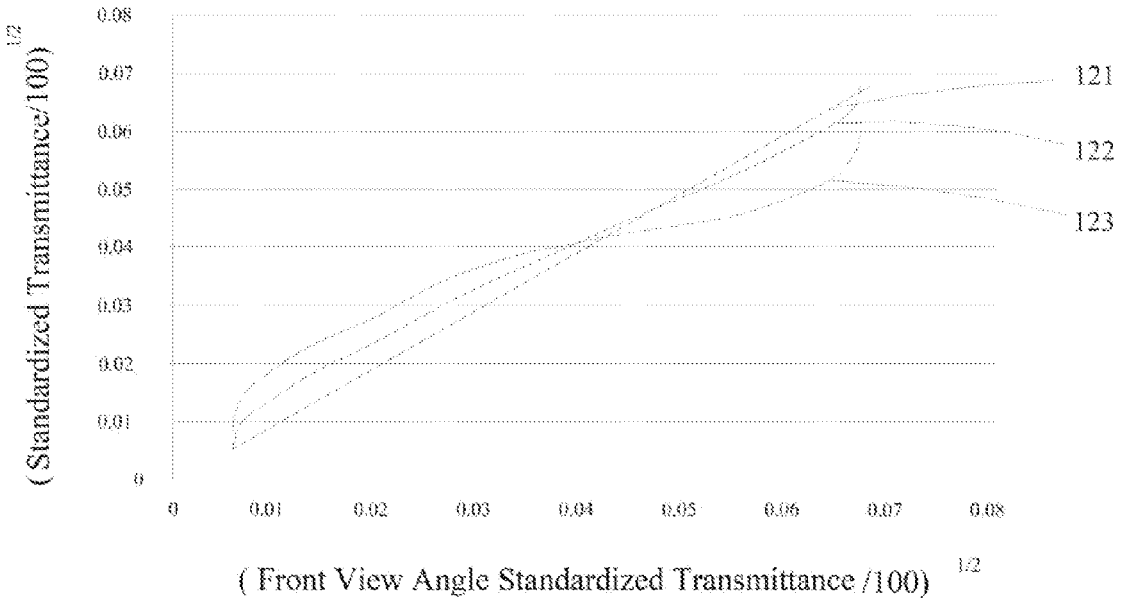
FIG. 12 is a plot of gamma (γ) characteristic of the liquid crystal display device according to the present invention.

Referring to FIGS. 10-12, FIG. 10 shows a plot of relationship between a drive voltage applied to the liquid crystal display device according to the present invention and transmittance; FIG. 11 is a plot of standardized transmittance curves by standardizing the curves of FIG. 10 with respect to white displaying; and FIG. 12 is a plot of gamma (γ) characteristic of the liquid crystal display device according to the present invention. As shown in FIG. 10, the liquid crystal display device 50 according to the present invention is applied with various drive voltages and transmittance of the liquid crystal display device 50 is observed at different view angles, wherein curve 101 is a plot of drive voltage and transmittance by taking a front view angle to observe the liquid crystal display device 50, curve 102 is a plot of drive voltage and transmittance by taking an angle of 30° shifted from the front view angle to observe the liquid crystal display device 50, and curve 103 is a plot of drive voltage and transmittance by taking an angle of 60° shifted from the front view angle to observe the liquid crystal display device 50.

As shown in FIG. 11, standardized transmittance curves include curves of standardized transmittance obtained by observing the liquid crystal display device 50 at various view angles, in which curve 111 is a plot of standardized transmittance of observing the liquid crystal display device 50 at the front view angle, curve 112 is a plot of standardized transmittance of observing the liquid crystal display device 50 at an angle of 30° shifted from the front view angle, and curve 113 is a plot of standardized transmittance of observing the liquid crystal display device 50 at an angle of 60° shifted from the front view angle. The displaying characteristics of the liquid crystal display device 50 are different for observation made at the front view angle and those made at an angle of 30° shifted from the front view angle and an angle of 60° shifted from the front view angle, so that the γ characteristics of displaying of the displaying surface of the liquid crystal display device 50 observed at different view angles are different.

As shown in FIG. 12, an illustration is given for further showing the difference between the γ characteristics of displaying obtained by observing the displaying surface of the liquid crystal display device 50 at different view angles, in which curve 121, curve 122, and curve 123 are associated with the following horizontal axis value: the horizontal axis value=(standardized transmittance at front view angle/100)$^{1/2}$, and curve 121, curve 122, and curve 123 are respectively associated with the following vertical axis values: vertical axis value=(standardized transmittance at front view angle/100)$^{1/2}$, vertical axis value=(standardized transmittance at 30° shifted from front view angle/100)$^{1/2}$, and vertical axis value=(standardized transmittance at 60° shifted from front view angle/100)$^{1/2}$. It can be seen that γ characteristic of the liquid crystal display device 50 shows significant deviation at different view angles. In the instant embodiment, the γ value of front side gray level characteristic is set 2.

Specifically, curve 121 shows gray level characteristic of the liquid crystal display device 50 at the front view angle, wherein the horizontal axis value=the vertical axis value, and thus curve 121 is a straight line. Curve 122 is the gray level characteristic of the liquid crystal display device 50 at angle of 30° shifted from the front view angle, and curve 123 is the gray level characteristic of the liquid crystal display device 50 at an angle of 60° shifted from the front view angle, wherein deviations between curve 122 and curve 123 and the front view angle gray level characteristic line 121 indicate the deviation of γ characteristic between view angles (30° shifted from the front view angle and 60° shifted from the front view angle), namely the deviation of the displayed gray level observed at the front view angle and each of the view angles. The smaller the deviation between curve 122 and curve 123 and the front view angle gray level characteristic line 121 is, the better the γ characteristic of the liquid crystal display device 50 will be. Ideally, curve 122 and curve 123 are straight lines coincident to the front view angle gray level characteristic line 121.

Figure 1:
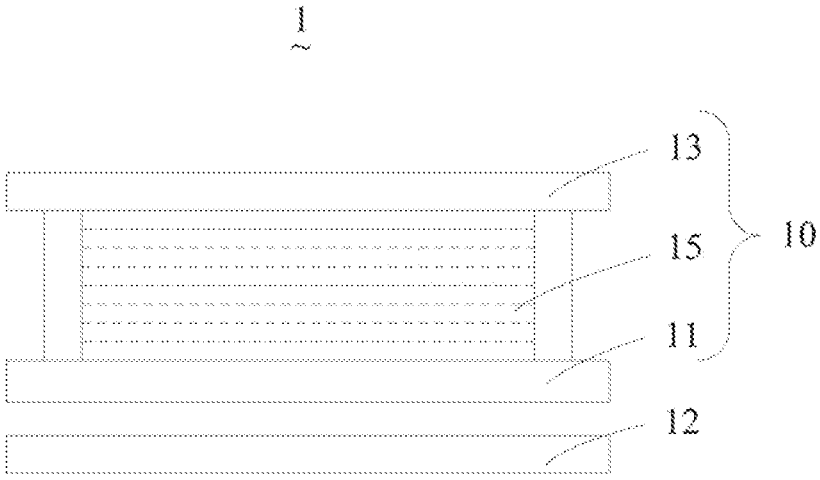
FIG. 1 (Prior Art)
FIG. 1 is a schematic view showing the structure of a known liquid crystal display device.
Figure 2:
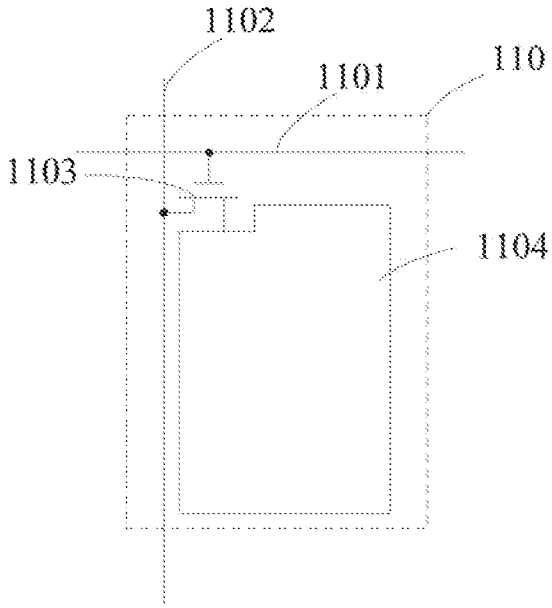
FIG. 2 (Prior Art)
FIG. 2 is an equivalent circuit diagram of each pixel unit of the liquid crystal display device shown in FIG. 1.
Figure 3:
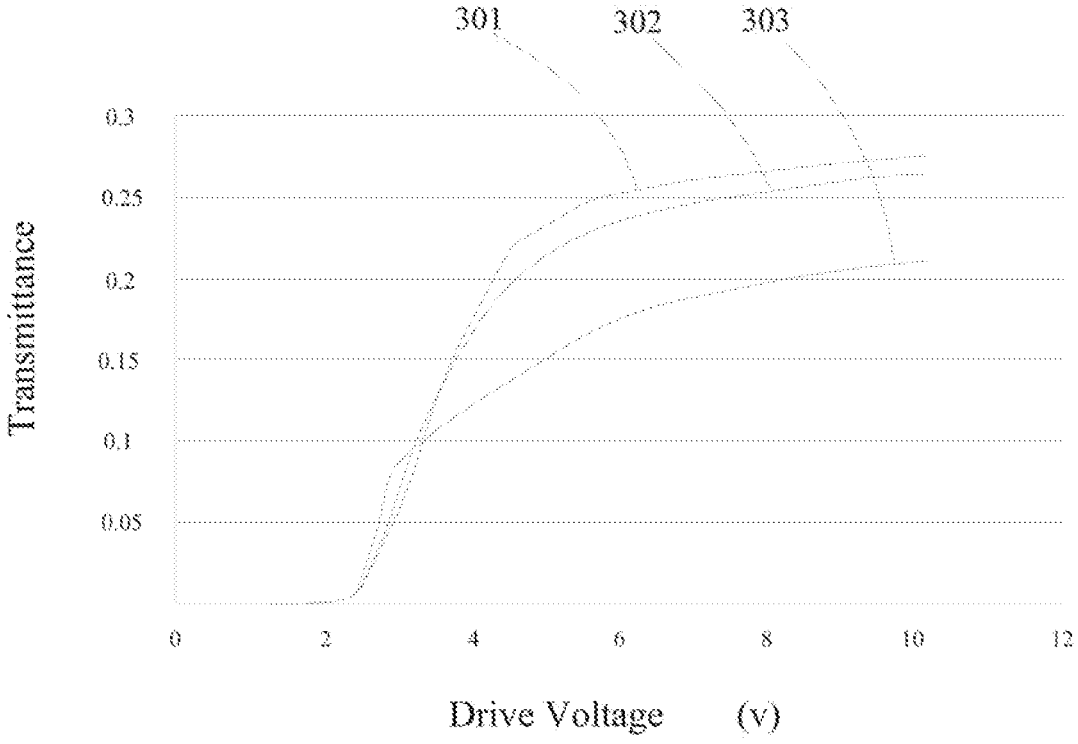
FIG. 3 (Prior Art)
FIG. 3 is a plot a plot of relationship between a drive voltage applied to the known liquid crystal display device and transmittance.
Figure 4:
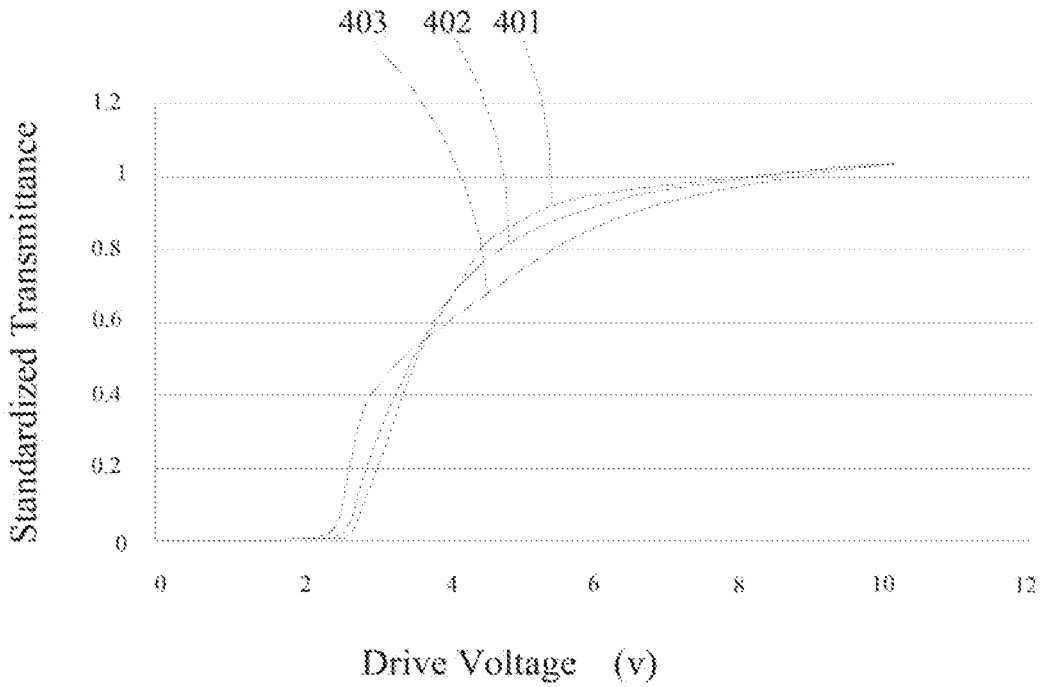
FIG. 4 (Prior Art)
FIG. 4 is a plot of standardized transmittance curves by standardizing the curves of FIG. 3 with respect to white displaying.
Figure 5:
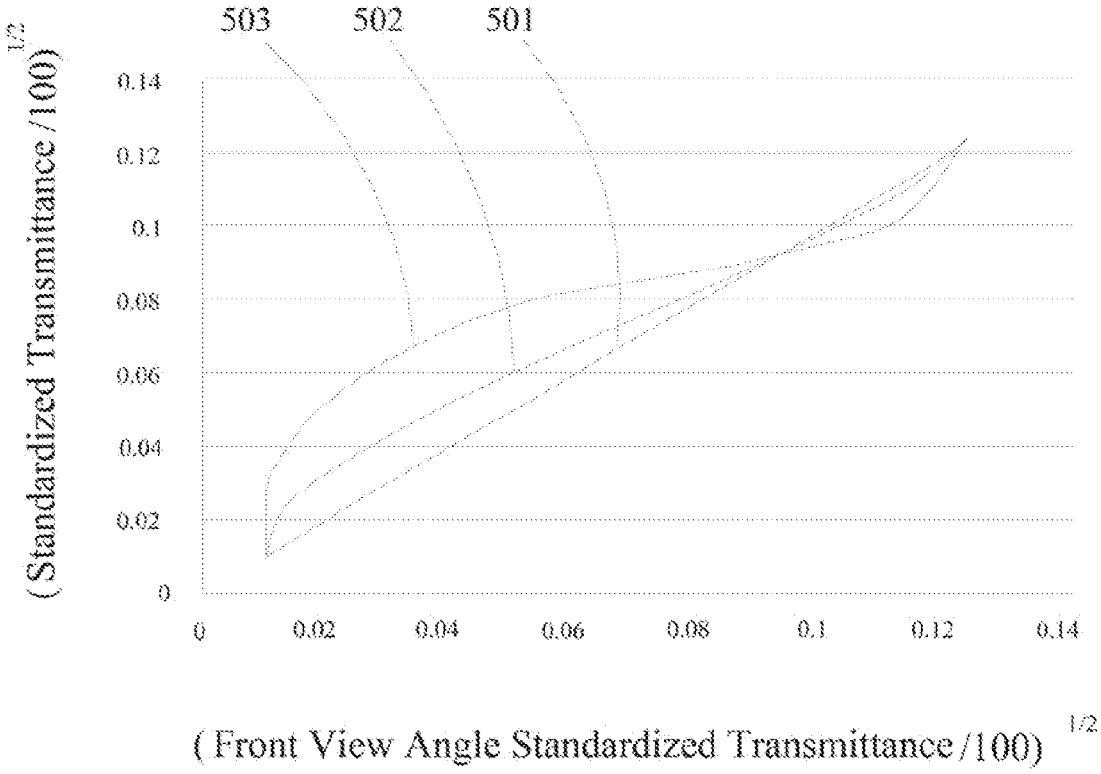
FIG. 5 (Prior Art)
FIG. 5 is a plot of gamma (γ) characteristic of the known liquid crystal display device.

To distinguish from the displaying characteristic of the conventional liquid crystal display device, a comparison is made between FIG. 12 and FIG. 5, in which the deviation between curve 122 and curve 123 and the front view angle gray level characteristic line 121 is smaller than the deviation between curve 502 and curve 502 and the front view angle gray level characteristic line 501. This indicates that the liquid crystal display device 50 according to the present invention improves the γ characteristic of the conventional liquid crystal display device, and the improvement is excellent one. In summary, the present invention improves the γ characteristic of the liquid crystal display device 50 by arranging each pixel unit 60 as a first sub-pixel electrode 61 and a second sub-pixel electrode 62 and setting the first sub-pixel electrode 61 at a central position of the pixel unit 60 and setting the second sub-pixel electrode 62 along a circumference of the first sub-pixel electrode 60, whereby the liquid crystal display device 50 may achieve improved performance of displaying and the displaying quality is enhanced.

Embodiments of the present invention have been described, but they are not intended to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A liquid crystal display device, which comprises: a plurality of pixel units arranged in a matrix form, wherein each of the pixel units further comprises:

a first sub-pixel electrode, which is set at a central position of the pixel unit; and a second sub-pixel electrode, which is circumferentially set along a circumference of the first sub-pixel electrode;

wherein an area of the first sub-pixel electrode and an area of the second sub-pixel electrode are of a ratio of 1:2, a drive voltage of a liquid crystal layer corresponding to the first sub-pixel electrode being a first drive voltage, a drive voltage of a liquid crystal layer corresponding to the second sub-pixel electrode being a second drive voltage, the first drive voltage being less than the second drive voltage; and wherein the second sub-pixel electrode comprises an outer circumference that is rectangular and an inner circumference that is rectangular and defines a rectangular hollow area, the first sub-pixel electrode having an outer circumference that is rectangular and substantially corresponds in shape and size to the rectangular hollow area of the second sub-pixel electrode so as to be received in the rectangular hollow area.

2. The liquid crystal display device as claimed in claim 1, wherein the pixel unit further comprises:

a scan line;

a data line, which is isolated from the scan line;

a first thin film transistor, which has a gate terminal connected to the scan line, the first thin film transistor having a source terminal connected to the data line, the first thin film transistor having a drain terminal connected to the first sub-pixel electrode;

a second thin film transistor, which has a gate terminal connected to the scan line, the second thin film transistor having a source terminal connected to the data line, the second thin film transistor having a drain terminal connected to the second sub-pixel electrode;

a first auxiliary capacitor and a first auxiliary capacitor line, the first auxiliary capacitor having an auxiliary electrode connected to the first sub-pixel electrode, the first auxiliary capacitor having an opposite electrode connected to the first auxiliary capacitor line; and a second auxiliary capacitor and a second auxiliary capacitor line, the second auxiliary capacitor having an auxiliary electrode connected to the second sub-pixel electrode, the second auxiliary capacitor having an opposite electrode connected to the second auxiliary capacitor line, the second auxiliary capacitor line being independent of the first auxiliary capacitor line.

3. A liquid crystal display device, which comprises: a plurality of pixel units arranged in a matrix form, wherein each of the pixel units further comprises a first sub-pixel electrode and a second sub-pixel electrode, wherein the first sub-pixel electrode is set at a central position of the pixel unit and the second sub-pixel electrode is circumferentially set along a circumference of the first sub-pixel electrode;

wherein the second sub-pixel electrode comprises an outer circumference that is rectangular and an inner circumference that is rectangular and defines a rectangular hollow area, the first sub-pixel electrode having an outer circumference that is rectangular and substantially corresponds in shape and size to the rectangular hollow area of the second sub-pixel electrode so as to be received in the rectangular hollow area.

4. The liquid crystal display device as claimed in claim 3, wherein the pixel unit further comprises:

a scan line;

a data line, which is isolated from the scan line;

a first thin film transistor, which has a gate terminal connected to the scan line, the first thin film transistor having a source terminal connected to the data line, the first thin film transistor having a drain terminal connected to the first sub-pixel electrode;

a second thin film transistor, which has a gate terminal connected to the scan line, the second thin film transistor having a source terminal connected to the data line, the second thin film transistor having a drain terminal connected to the second sub-pixel electrode;

a first auxiliary capacitor and a first auxiliary capacitor line, the first auxiliary capacitor having an auxiliary electrode connected to the first sub-pixel electrode, the first auxiliary capacitor having an opposite electrode connected to the first auxiliary capacitor line; and a second auxiliary capacitor and a second auxiliary capacitor line, the second auxiliary capacitor having an auxiliary electrode connected to the second sub-pixel electrode, the second auxiliary capacitor having an opposite electrode connected to the second auxiliary capacitor line, the second auxiliary capacitor line being independent of the first auxiliary capacitor line.

5. The liquid crystal display device as claimed in claim 4, wherein a drive voltage of a liquid crystal layer corresponding to the first sub-pixel electrode is a first drive voltage and a drive voltage of a liquid crystal layer corresponding to the second sub-pixel electrode is a second drive voltage, wherein the first drive voltage is less than the second drive voltage.

6. The liquid crystal display device as claimed in claim 3, wherein an area of the first sub-pixel electrode and an area of the second sub-pixel electrode are of a ratio of 1:2.

7. The liquid crystal display device as claimed in claim 3, wherein the first sub-pixel electrode comprises a first zone, a second zone, a third zone, and a fourth zone, the first zone and the second zone being arranged to juxtapose each other, the third zone being arranged diagonally with respect to the first zone, the fourth zone being arranged diagonally with respect to the second zone.

8. The liquid crystal display device as claimed in claim 7, wherein the first zone and the third zone have same electrode direction and the second zone and the fourth zone have the same electrode direction.

9. The liquid crystal display device as claimed in claim 7, wherein the electrode direction of the first zone and the third zone is set in a first direction and the electrode direction of the second zone and the fourth zone is set in a second direction, the first direction and the second direction being normal to each other.

10. The liquid crystal display device as claimed in claim 9, wherein the first direction is a direction forming an included angle of 135° with respect to positive horizontal direction and the second direction is a direction forming an included angle of 45° with respect to the positive horizontal direction.

11. The liquid crystal display device as claimed in claim 7, wherein the second sub-pixel electrode has a first portion set outside the first zone and having an electrode direction corresponding to electrode direction of the first zone, the second sub-pixel electrode has a second portion set outside the second zone and having an electrode direction that corresponding to electrode direction of the second zone, the second sub-pixel electrode has a third portion set outside the third zone and having an electrode direction corresponding to electrode direction of the third zone, and the second sub-pixel electrode has a fourth portion set outside the fourth zone and having an electrode direction corresponding to electrode direction of the fourth zone.

12. A liquid crystal display device, which comprises: a plurality of pixel units arranged in a matrix form, wherein each of the pixel units further comprises:

a pixel central portion, which is arranged at a center of the pixel unit; and a pixel edge portion, which is arranged along an edge of the pixel unit and circumferentially surrounds a circumference of the pixel central portion;

wherein the pixel edge portion comprises an outer circumference that is rectangular and an inner circumference that is rectangular and defines a rectangular hollow area, the pixel central portion having an outer circumference that is rectangular and substantially corresponds in shape and size to the rectangular hollow area of the pixel edge portion so as to be received in the rectangular hollow area.

13. The liquid crystal display device as claimed in claim 12, wherein a drive voltage of a liquid crystal layer corresponding to the pixel central portion is a first drive voltage and a drive voltage of a liquid crystal layer corresponding to the pixel edge portion is a second drive voltage, wherein the first drive voltage is less than the second drive voltage.

14. The liquid crystal display device as claimed in claim 12, wherein an area of the pixel central portion and an area of the pixel edge portion are of a ratio of 1:2.

* * * * *